United States Patent [19]

Miller

[11] 4,275,581

[45] Jun. 30, 1981

[54] METHOD FOR INCREASING THE FIN DENSITY OF A HEAT EXCHANGER

[75] Inventor: Kenneth J. Miller, Peoria, Ill.

[73] Assignee: Caterpillar Tractor Co., Peoria, Ill.

[21] Appl. No.: 918,630

[22] Filed: Jun. 23, 1978

[51] Int. Cl.[3] ..... B21D 13/02

[52] U.S. Cl. ..... 72/385; 72/307; 72/379; 72/421

[58] Field of Search ..... 72/307, 316, 385, 379, 72/421, 187; 140/105

[56] References Cited

U.S. PATENT DOCUMENTS

| | | | |
|---|---|---|---|
| 3,461,711 | 8/1969 | Ogilvie | 72/385 X |
| 3,628,369 | 12/1971 | Williamson | 72/385 |
| 3,670,781 | 6/1972 | Liouville | 72/187 |

*Primary Examiner*—Leon Gilden
*Attorney, Agent, or Firm*—Phillips, Moore, Weissenberger, Lempio & Majestic

[57] ABSTRACT

An apparatus (40) and method for increasing the fin density of a serpentine sheet (10) having a plurality of fins (14*a*, 14*b*, 14*c*), each fin having two sides (16, 18) coupled together at one end (20) with a space (22) between the sides. Blocks (30, 32) having receptacles (30*a*, 32*a*) for receiving the ends (20, 24) of one side (16) of a fin (14*a*) and being near opposite surfaces (A, B) of the sheet (10) are moved vertically into contact with such ends. Simultaneously, blades (34, 36), being near the opposite surfaces (A, B) of the sheet (10) are moved vertically into position at the other side (18) of the fin (14*a*). Then, the blades (34, 36) are moved horizontally towards the blocks (30, 32), which are now held stationary, to compress the fin (14*a*) a predetermined amount by moving the other fin side towards the one fin side. The blocks and blades are then withdrawn from the sheet to move another fin (14*b*) into position for another compressing operation. The apparatus (40) includes a mechanism (70) to prevent the sheet from fishtailing when a fin is being compressed.

5 Claims, 6 Drawing Figures

CORRUGATION APPARATUS
10
38
70
72
74
76
34
36
64
52
68
30
32
50
56
44
46
48
28
54
A
B
66
28
62
60
58
40
42
10
80
82

METHOD FOR INCREASING THE FIN DENSITY OF A HEAT EXCHANGER

TECHNICAL FIELD

This invention relates to an apparatus and method for increasing the fin density of corrugated sheet material having a plurality of fins for use as primary surface plates of heat exchangers.

BACKGROUND ART

Apparatus for corrugating relatively thin deformable sheet material for use as the primary surface plates of fixed type heat exchangers or recuperators for gas turbines or the like is known in the art. In one technique, as disclosed in U.S. Pat. No. 3,892,119, by Kenneth J. Miller et al., issued July 1, 1975, the corrugating apparatus receives substantially flat and relatively thin deformable sheet material which is then shaped into a relatively narrowly grooved corrugated configuration having a determined number of fins per inch, the cnfiguration being serpentine. The apparatus is such that the corrugations in the sheet material are formed individually in a sequential manner to minimize any stretching or tearing of the material.

More particularly, the flattened material is transported to a fin shaping station which has a plurality of forming blades on either side of the material. These blades are actuated or moved sequentially into contact with the flattened sheet material to form one fin of the corrugated sheet. After forming this one fin, the blades are moved away from the sheet and the latter indexed or moved one fin position so that the blades again can be actuated to contact the sheet and form another fin.

For example, with such prior corrugation apparatus, a first lower blade is raised into contact with one side of the flattened sheet material and then a second upper blade on the other side of the material is lowered into a groove of a previously formed fin to act as a clamp for the forming of the next fin. These two blades are on opposite sides of one wall of the previously formed fin. Next, a third upper blade is lowered into contact with the flattened material to fold such material around the first blade and thereby form a wall of the fin being formed. Finally a fourth lower blade is raised to fold the material around the third blade, and thereby form another wall of the fin being formed.

As is known, it is desirable to obtain as high a fin density as possible. With more fins per inch, there will be a greater surface area per unit volume, resulting in greater heat transfer because of the increased surface area. The above-described aparatus is capable of producing about 40 fins per inch, which is a significant improvement over other known apparatus which can form the sheet material into corrugations providing only about 25 fins per inch.

DISCLOSURE OF THE INVENTION

In one aspect of the present invention, a method is provided for increasing the fin density of a serpentine sheet having a plurality of fins in which the sheet is supplied to a fin compressing work station. In the work station, the serpentine sheet is held on either side of a first uncompressed fin. Then, the two sides of the uncompressed fin are brought closer together to compress the first fin. After this comressing operation, the sheet is no longer held and a second uncompressed fin is moved into the work station to compress the latter in the same manner.

In another aspect of the present invention, apparatus is provided for performing this fin compressing method comprising means for clamping the sheet on either side of a first uncompressed fin, including first means for contacting the sheet at one side of a first fin and second means for contacting the sheet at the other side of the first fin, and means for bringing closer together the first and second contacting means, thereby compressing the fin.

The above-mentioned prior 40 fin per inch forming apparatus is capable of producing even a higher fin density corrugated sheet. This would involve using narrower or thinner forming blades which would thereby reduce the width of the grooves of the fins; however, there is a limit to the minimum thickness of the forming blades. If these blades are made too narrow, this will increase the wear of the blades, thereby requiring that they be replaced more often. Also, the relatively thinner blades are more fragile, which means that they are more susceptible to breakage. Furthermore, the more narrow the blade, the more expensive it is to manufacture, thereby increasing the cost of the fin forming apparatus. In addition, the more narrow blades will be lighter and this reduces the speed of formation of the fins because of inertia problems with the lighter blades.

With the method and apparatus of the present invention, all of the advantages of the prior 40 fin per inch corrugating apparatus are maintained while not requiring the use of relatively thin blades for forming the serpentine sheet. The prior apparatus can still operate at its relatively high fin formation speed and with relatively thick blades which will not wear quickly or be unduly flexible. At the same time, with the present invention the serpentine sheet can be modified into a higher fin density sheet of about 45 to 90 fins per inch depending on the requirements of, for example, a heat exchanger.

BEST MODE FOR CARRYING OUT THE INVENTION

Figure 1:
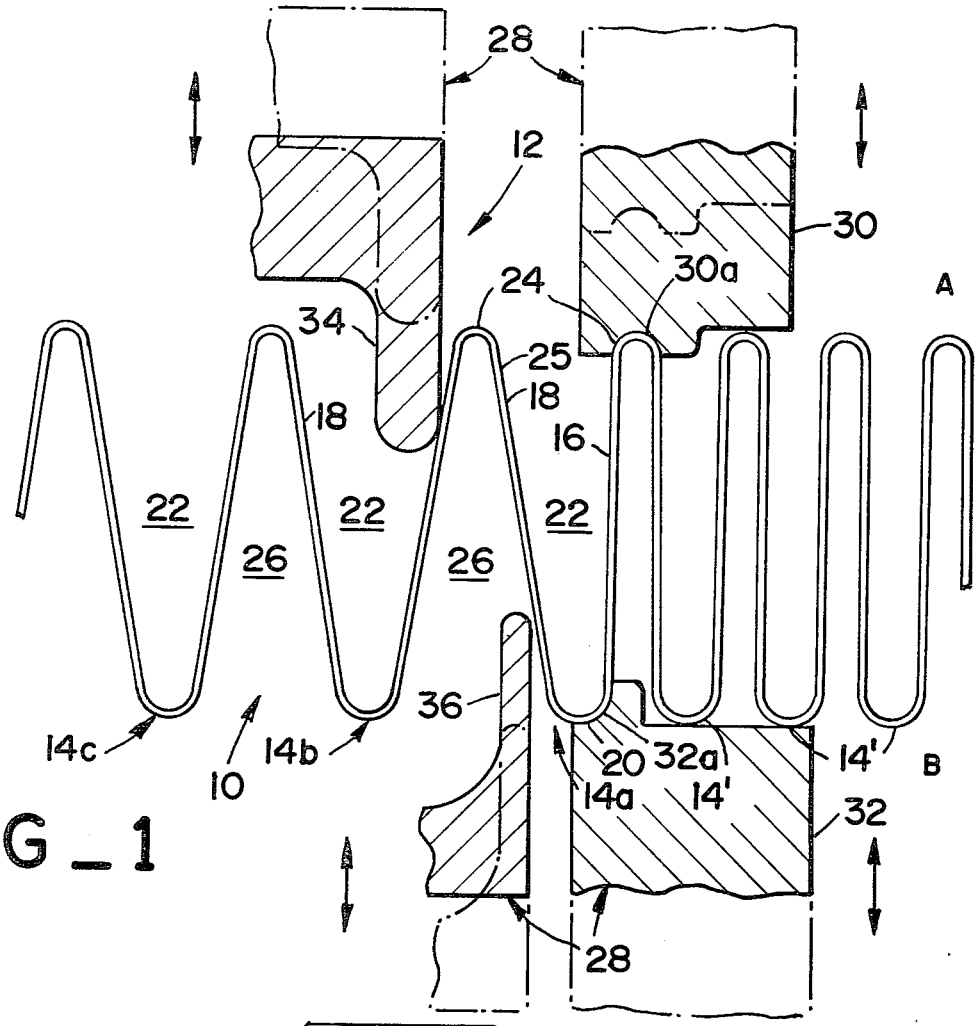
FIGS. 1 and 2 are enlarged diagrammatic views which together show essentially an embodiment of the fin compressing technique of the present invention.
Figure 2:
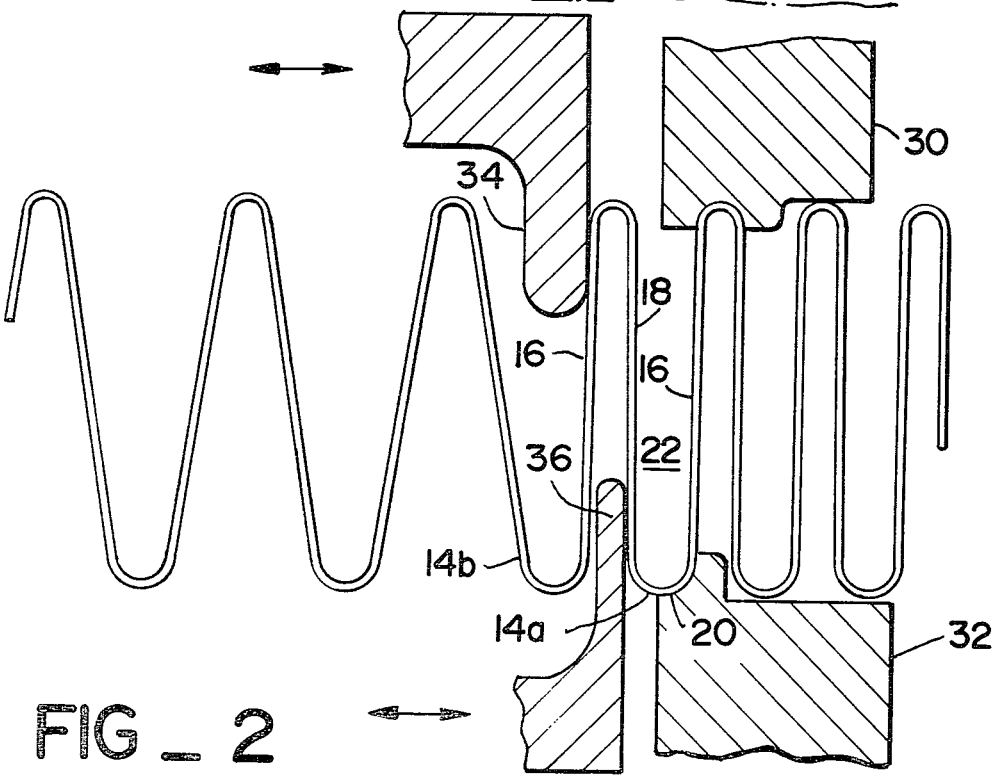

The invention can best be understood by reference to FIGS. 1 and 2 which illustrate, essentially, the steps for increasing the fin density of a serpentine sheet by compressing the respective fins. FIG. 1 illustrates a fin which is about to be compressed, while FIG. 2 illustrates the fin after it has been compressed.

A serpentine sheet 10 is supplied to a fin compressing work station 12 and includes a plurality of succeeding fins 14*a*, 14*b* and 14*c* which are to be compressed. The output of the work station 12 includes a sheet 10 having a plurality of preceding compressed fins 14'.

As represented by fin 14*a*, each uncompressed fin includes a first side 16 and a second side 18 connected together at one end 20, there being a first space or groove 22 between the two diverging sides 16 and 18. Side 16 has another or second end 24 opposite the one end 20 while side 18 has another or second end 25. A second space or groove 26 lies between two adjacent fins such as fins 14*a* and 14*b*.

A sheet clamping means 28 is employed to compress the uncompressed fin 14*a*. The clamping means 28 includes a pair of movable blocks 30 and 32 on opposite surfaces or sides A and B, respectively, of the sheet 10 for holding or gripping or clamping the opposite ends 24 and 20, respectively, of one side 16 of the fin 14*a*. Block 30 has a receptacle 30*a* conforming to the end 24 and is movable vertically into contact with such end 24, while block 32 has a receptacle 32*a* conforming to end 20 and is also movable vertically into contact with such end 20.

The clamping means 28 also includes a pair of blades 34 and 36, on opposite surfaces A and B, respectively, of the sheet 10. Blade 34 is movable vertically into the space 22 of the fin 14*b* to contact or engage one side 16 of fin 14*b* intermediate the ends of this one side. The blade 36 is movable vertically into the space 26 between fins 14*a* and 14*b* to contact or engage the side 18 of the former fin intermediate its ends. As shown in FIG. 2, blades 34 and 36 are also movable horizontally to bring the side 18 of fin 14*a* closer to side 16 of fin 14*a* while side 16 is held stationary by the blocks 30 and 32.

INDUSTRIAL APPLICABILITY

In operation, once fin 14*a* is in the work compressing station 12, block 30 and blade 34 on the one hand, and block 32 and blade 36 on the other hand, are moved simultaneously from their dotted line positions shown in FIG. 1 into their full line positions shown in FIG. 1. Thus, prior to compressing the fin 14*a*, one side 16 is held stationary within the receptacles 30*a* and 32*a* of the respective blocks 30 and 32, while blade 34 contacts side 16 of fin 14*b* and blade 36 contacts side 18 of fin 14*a*. Then, as shown in FIG. 2, the blades 34 and 36 are moved simultaneously horizontally a predetermined distance towards stationary blocks 30 and 32 to move side 18 of fin 14*a* into a substantially vertical position, thereby compressing fin 14*a*. At the same time, side 16 of fin 14*b* is brought into a substantially vertical alignment. The result is that each fin such as fin 14*a* has substantially parallel sides 16, 18. After this horizontal movement, the blocks 30 and 32 and the blades 34 and 36 are withdrawn simultaneously vertically out of contact with sheet 10 so that fin 14*b* can be indexed or moved one fin position in the work station 12 to be compressed in the same manner as fin 14*a*. After this withdrawal, blades 34 and 36 will also be moved horizontally to the start position shown in phantom lines in FIG. 1 prior to compressing fin 14*b*.

Figure 3:
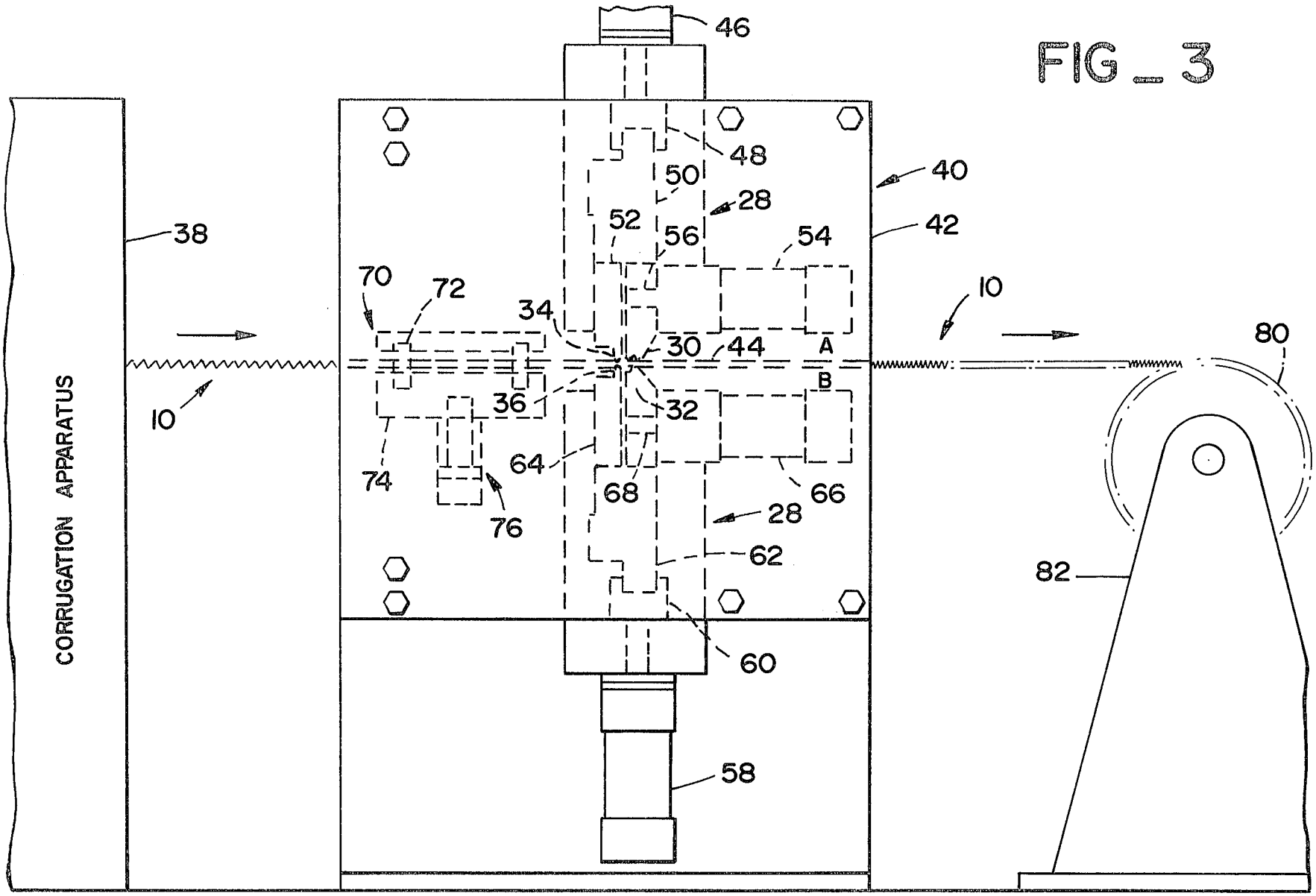
FIG. 3 is a side elevational view of an embodiment of the fin compressing apparatus of the present invention.

FIG. 3 illustrates the apparatus for performing the method described in connection with FIGS. 1 and 2. Block 38 represents a known apparatus for corrugating sheet material having a fin density of about 40 fins per inch. The output of this apparatus 38 is the serpentine material 10 that is fed to apparatus 40 of the present invention which compresses the fins in the manner shown in FIGS. 1 and 2. The apparatus 38 may be that described in the above-noted U.S. Pat. No. 3,892,119 to Miller et al.

Apparatus 40 includes a frame assembly 42 in which there is a path 44 for the movement of sheet material 10 therethrough. The clamping means 28 is shown on both sides A and B of this path 44. On side A, and supported by frame 42, is a hydraulic cylinder 46 and a cylinder rod 48 which is connected to a slide block or support 50. This block 50 is slidable vertically and supports a slide plate 52 which is movable laterally. Another hydraulic cylinder 54 has a cylinder rod 56 coupled to plate 52 to slide the latter laterally. Cylinder 54 and rod 56 are connected to support 50 to move vertically with this support while being able to move plate 52 laterally. The block 30 shown in FIG. 1 is connected to support 50 to move only vertically, while the blade 34 is coupled to plate 52 to move both vertically and laterally.

On side B of the path 44 is a hydraulic cylinder 58 having a cylinder rod 60 coupled to another block or support 62 to move the latter vertically. Block 62 supports a slidable plate 64 which is movable laterally by a cylinder 66 and a cylinder rod 68 which are also supported by the block 62. Support 62 carries the block 32 shown in FIG. 1 for movement only vertically, while plate 64 carries the blade 36 for movement both vertically and laterally.

Also illustrated in FIG. 3 is a mechanism 70 for holding the corrugated sheet 10 while one of the fins 14*a*, 14*b*, 14*c*, etc. is being compressed by the clamping means 28. This mechanism 70 includes plates 72 and 74 on opposite sides A and B, respectively, of the path 44. Plate 74 is fixed while plate 72 is movable vertically in relation to plate 74 by a hydraulic cylinder means 76 as will be shown more clearly in FIG. 6. Prior to compressing one of the fins, plate 72 is moved downwardly so that sheet material 10 is sufficiently held on its upper and lower sides by the plates 72 and 74. This will prevent "fishtailing" of the sheet 10 when one of the fins is being compressed. After compression of the fin, plate 72 is elevated to enable the sheet 10 to be moved one fin position for compressing another fin.

The output of apparatus 40 is the corrugated sheet 10 having the compressed fins 14'. This sheet is fed to a take-up reel 80 which is rotatably supported by a frame 82. The compressed sheet is thereby stored on reel 80 for use later in the manufacture of, for example, heat exchangers.

Figure 4:
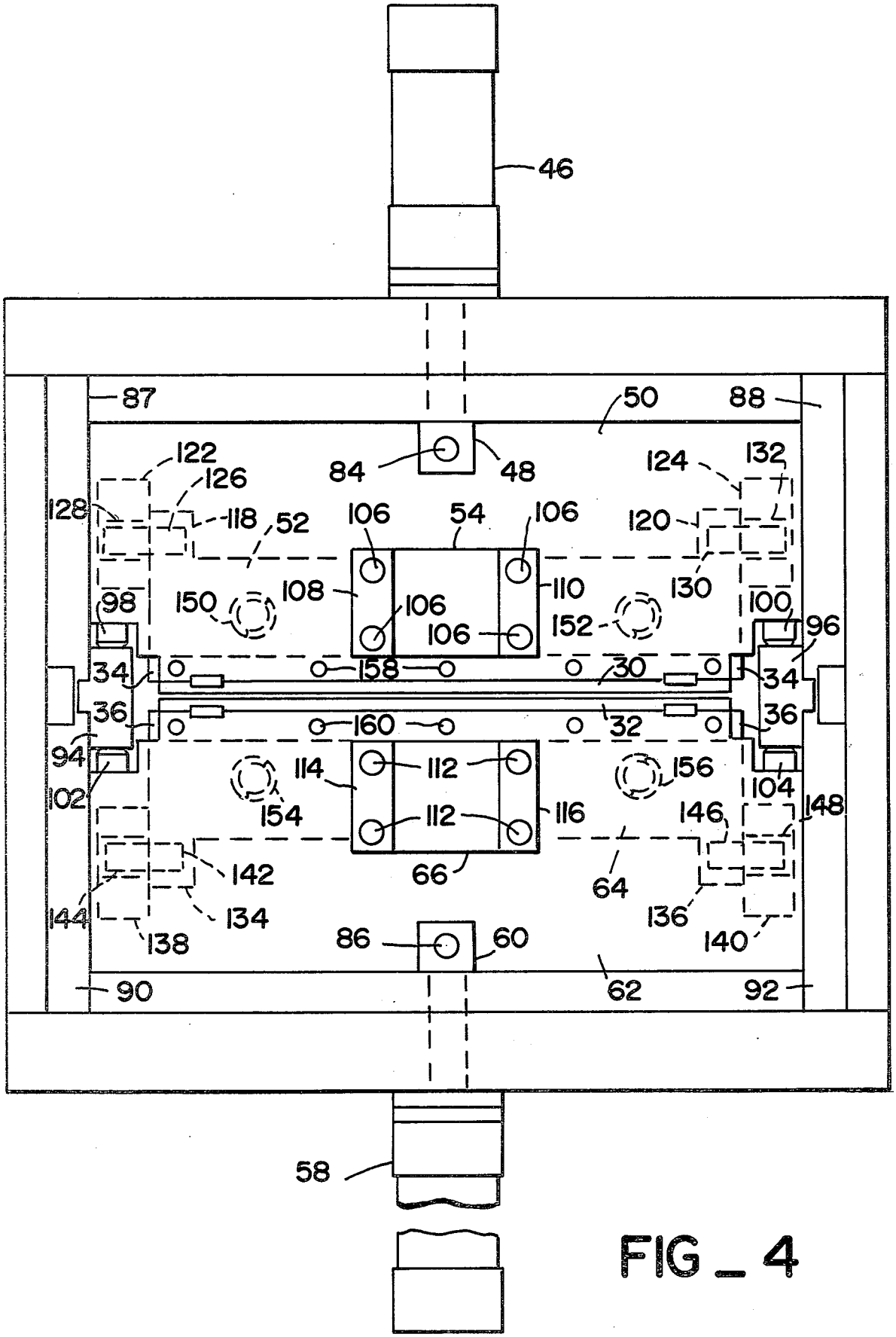
FIG. 4 is an end elevational view of the fin compressing apparatus of the present invention.

With reference to FIG. 4, rod 48 of cylinder 46 is coupled to the support 50 by a pin connection 84. Similarly, rod 60 of cylinder 58 is coupled to support 62 by a pin connection 86. Support 50 is slidable at either side in vertically extending guide rails 87 and 88, and block 62 is slidable at either side in vertically extending guide rails 90 and 92. A stop member 94 is connected between the ends of guide rails 87 and 90 while another stop member 96 is connected between the ends of guide rails 88 and 92. Support 50 has two respective protrusions 98 and 100 on either side which come in contact with one end of respective stop members 94 and 96. Support 62 has two respective protrusions 102 and 104 on either side which come in contact with the other end of stop members 94 and 96, respectively. Stop members 94 and 96, and protrusions 98 and 100 are positioned so that support 50 will be stopped on its downward movement when block 30 and blade 34 are in their full line positions shown in FIG. 1. Similarly, stop members 94 and 96 and protrusions 102 and 104 are positioned so as to stop the upward movement of support 62 when block 32 and blade 36 are in their full line positions shown in FIG. 1. In this manner, the blades 34 and 36 are prevented from cutting through the sheet material 10, and blocks 30 and 32 are prevented from deforming the ends 24 and 20 of the material 10.

As also shown in FIG. 4, cylinder 54 is bolted to plate 50 by four bolts 106 extending through flanges 108 and 110 of the cylinder 54. Similarly, cylinder 66 is connected to plate 62 by four bolts 112 extending through flanges 114 and 116 of the cylinder 66. The slide plate 52, being movable horizontally with the use of cylinder 54 and rod 56, has flanges 118 and 120, and support 50 has brackets 122 and 124 aligned with these flanges 118 and 120, respectively. A dowel 126 extends from flange 118 and into an elongated opening 128 of bracket 122, and another dowel 130 extends from flange 120 and into an elongated opening 132 of the bracket 124. In this manner, plate 52 is connected to support 50 so as to move vertically therewith, while dowels 126 and 130 are slidable laterally along openings 128 and 132 to enable the plate 52 to move horizontally in relation to support 50, as described in connection with FIG. 3.

Slide plate 64, being movable horizontally with the use of cylinder 66 and rod 68, is coupled to support 62 in a similar manner as plate 52 is coupled to support 50. Plate 64 has flanges 134 and 136 aligned with brackets 138 and 140 of support 62. A dowel 142 extends from flange 134 into an elongated opening 144 of bracket 138 and another dowel 146 extends from flange 136 into an elongated opening 148 of bracket 140. Thus, plate 64 can move vertically with block 62 and move laterally in relation to support 62 as described in FIG. 3 by the sliding of dowels 142, 146 in openings 144, 148.

Two springs 150 and 152 are coupled between plate 52 and support 50 to cushion the relative movement of these two members, and two springs 154 and 156 are coupled between plate 64 and block 62 to cushion the relative movement of these two members. A number of head sockets 158 connect block 30 to support 50 and a number of head sockets 160 connect block 32 to support 62. Blades 34 and 36 may be similarly connected to plates 52 and 64, respectively.

Figure 5:
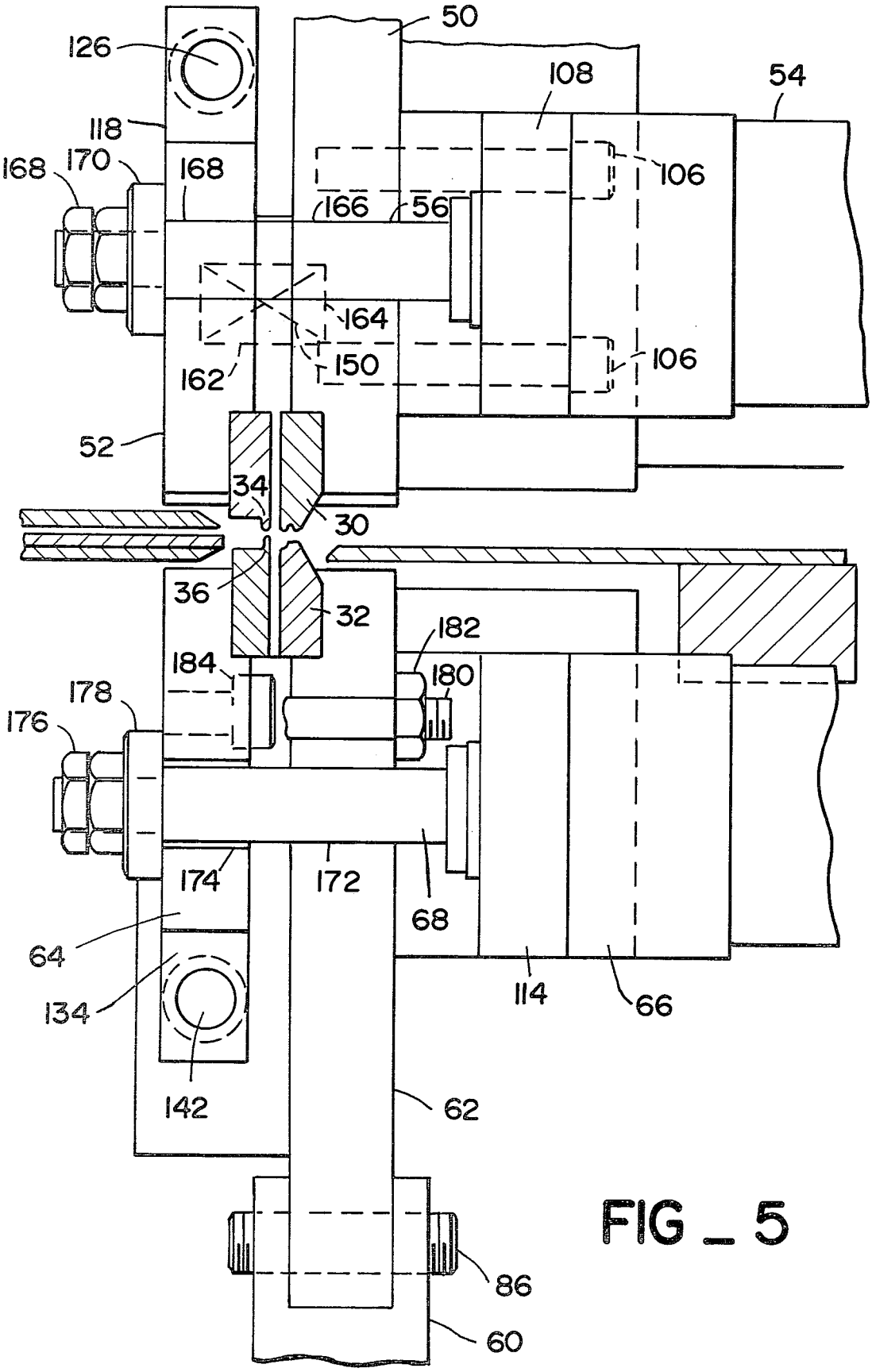
FIG. 5 is an enlarged vertical sectional view 5—5 of the apparatus circled in FIG. 6.

FIG. 5 shows in more detail the manner in which blades 34 and 36 are movable laterally towards blocks 30 and 32, respectively, to compress a fin of sheet 10. The plate 52 is spaced from the support 50 with the spring 150 extending therebetween, the spring 150 disposed within respective openings 162 and 164 of plate 52 and support 50. The rod 56 of cylinder 54 extends through support 50 and plate 52 via respective openings 166 and 168. Rod 56 is slidable through opening 166 but is rigidly connected to plate 52 by a nut 168 and washer 170.

Plate 64 also is spaced from support 62 as shown in FIG. 5. Rod 68 of cylinder 66 extends through an opening 172 of support 62 and an opening 174 of plate 64. Rod 68 is slidable through support 62 and fixed to plate 64 by a nut 176 and washer 178. A rod 180 is fixedly connected to support 62 by a nut 182 and extends partially from the support towards the plate 64. Plate 64 has a protrusion 184 which functions as a stop member to stop the movement of the plate 64 towards support 62, when the rod 180 and protrusion 184 come into contact. With this stop member, one side 18 of fin 14*a* is brought closer to the other side 16 of fin 14*a* by a predetermined amount, thereby preventing the fin 14*a* from being compressed beyond a desired amount.

For purposes of simplifying the drawings, FIG. 5 shows only the spring 150 coupled between the plate 52 and support 50. However, as indicated in FIG. 4, the plate 64 and support 62 similarly have the spring 154 connected therebetween. Springs 152 and 156 are coupled to plate 64 and support 62 in the same manner, respectively, as spring 150 and 154. Also, for the same purpose, only one stop member including rod 180 and protrusion 184 is shown between plate 66 and support 62. However, a similar stop member is situated between plate 52 and support 50 to prevent the compressing of a fin beyond a desired amount.

The relative positions shown in FIG. 5 of the blade 34 and block 30 on the one hand, and the blade 36 and block 32 on the other hand, are as shown in the full lines in FIG. 1. When hydrualic fluid is introduced into cylinders 54 and 66 to compress fin 14*a*, rods 56 and 58 will be retracted into their respective cylinders, carrying plates 52 and 64 with them. This will cause the springs 150, 152, 154 and 156 to compress and bring the side 18 of fin 14*a* towards the stationary side 16 of the fin until the protrusion 184 comes into contact with rod 180. Then, hydraulic fluid will be introduced into cylinders 46 and 58 to retract their respective rods 48 and 60, thereby removing blocks 30 and 32 and blades 34 and 36 from contact with the sheet 10. Then, hydraulic fluid is discharged from the cylinders 54 and 66 to move plates 52 and 64, and hence blades 34, 36 away from the respective blocks 30 and 32 under the force of springs 150, 152, 154, and 156 to the dotted line positions of FIG. 1.

Figure 6:
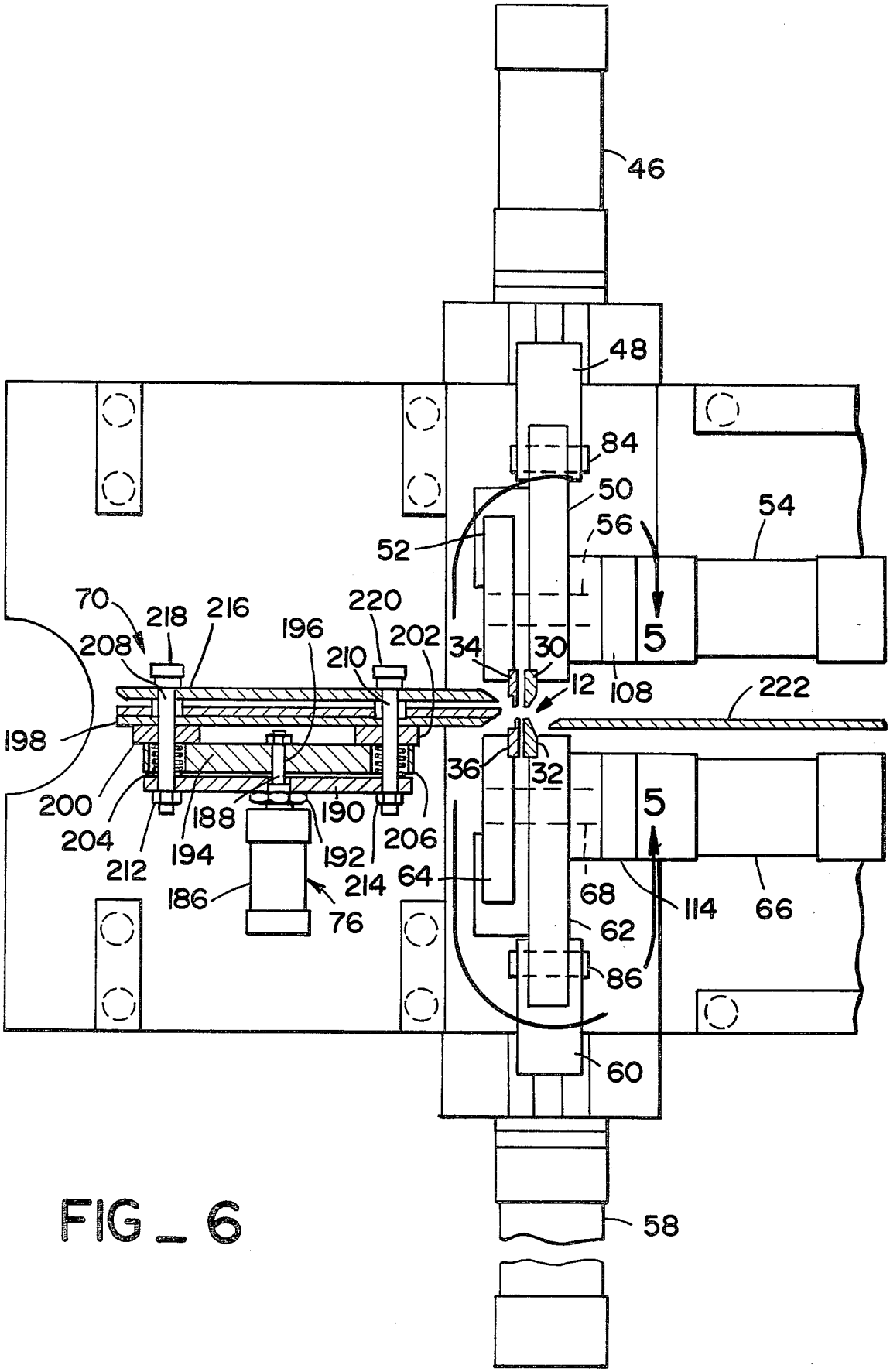
FIG. 6 is a side elevational view, partly in section, showing details of the apparatus of FIG. 3.

FIG. 6 shows in more detail the holding mechanism 70 shown in FIG. 3. The hydraulic mechanism 76 includes a hydraulic cylinder 186 and a cylinder rod 188. Rod 188 is fixedly connected to a movable plate 190 by a nut 192 and extends through a fixed plate 194 having a hole 196 through which rod 188 is slidable. Fixed plate 194 is coupled to a fixed plate 198 by two guide rails 200 and 202. A pair of springs 204 and 206 are coupled between guide rail 200 and guide rail 202, respectively, and plate 190 through plate 194. Two lift bolts 208 and 210 are fixedly connected at one end to plate 190 by nuts 212 and 214, respectively. These bolts 208 and 210 extend through plate 194, respective guide rails 200, 202 and plate 198 to a plate 216 which is movable in a vertical direction. Bolts 208 and 210 are coupled to this plate 216 by nuts 218 and 220.

Plates 198 and 216 define one part of the path 44 over which the uncompressed serpentine sheet material 10 is transported. Another plate 222 constitutes a table on which the compressed fins 14' are transported out of the apparatus 40 and also defines part of the path 44.

The normal relative position of the plates 216 and 198 is as shown in FIG. 6. That is, these two plates are normally in a position such as to hold the sheet material 10 on either side A and B to prevent it from being moved forwardly over path 44. Thus, when a fin is being compressed, these two plates will be in their normal state to prevent "fishtailing" of the material. After the fin compressing operation, hydraulic fluid is introduced into cylinder 186 to raise rod 188 and with it, plate 190, to move the latter towards fixed plate 194. This movement also raises lift bolts 208 and 210, along with plate 216, so that the sheet material 10 is now free to move one fin position for compressing another fin. Then, the hydraulic fluid is discharged from the cylinder 186 and the plate 190 allowed to descend with a force provided by the compressed springs 204 and 206, thereby moving plate 216 downwardly and holding firmly the sheet material 10 in anticipation of another fin compressing operation.

While not described herein, one type of mechanism for moving the sheet material 10 the one fin position is disclosed in the U.S. Pat. No. 3,892,119 to Miller et al. Such a mechanism may sequentially feed a predetermined amount of material 10 into the apparatus 40 to position a fin at the fin compressing work station 12 prior to compressing the fin.

Other aspects, objects and advantages of this invention can be obtained from a study of the drawings, the disclosure and the appended claims.

What is claimed is:

1. A method of increasing the fin density of a serpentine sheet (10) having a plurality of fins (14*a*, 14*b*, 14*c*), each fin having first (16) and second (18) diverging sides connected to each other at one rounded end (20) thereof with a first space (22) therebetween, the other end (24) of the first side (16) of a fin being connected to the other end (25) of the second side (18) of the preceding fin to form another rounded end (24, 25) and the other end (25) of the second side (18) of a fin being connected to the other end (24) of the first side (16) of the succeeding fin, and two adjacent fins having a second space (26) therebetween, the method comprising:

(a) vertically moving a first clamping member (30) onto the other rounded end (24, 25)

(b) vertically moving a second clamping member (32) onto the one rounded end (20) of one fin;

(c) vertically moving a first blade (34) into the first space (22) of an adjacent fin succeeding the one fin and into contact with an intermediate area of the first side (16) thereof;

(d) vertically moving a second blade (36) into the second space (26) between the one fin and the adjacent fin and into contact with an intermediate area of the second side (18) of the one fin;

(e) moving the first blade (34) and the second blade (36) laterally towards the first clamping member (30) and the second clamping member (32) to reduce the divergence of the first (16) and second (18) sides of a fin; and (f) vertically moving the first clamping member (30), the second clamping member (32), the first blade (34) and the second blade (36) away from the one fin after moving the first blade (34) and the second blade (36) laterally.

2. A method of increasing the fin density of a serpentine sheet (10) having a plurality of fins (14*a*, 14*b*, 14*c*), each fin having two diverging sides (16,18) connected at one end (20) and a first space (22) therebetween, each side (16,18) having another end (24), and two adjacent fins (14*a*, 14*b*) having a second space (26) therebetween, comprising:

(a) supplying the sheet (10) to a fin compressing work station (12);

(b) clamping the sheet (10) on either side (16, 18) of a first uncompressed fin (14*a*) of the sheet with clamping means (28), including (i) holding one side (16) of the first fin (14*a*) at either of the ends (20,24) of the one side (16), including moving first (30) and second (32) members of the clamping means (28) onto either end (20,24) of the one side (16) of the first fin (14*a*), (ii) contacting a side (16) of a second fin (14*b*) at an intermediate area thereof, the second fin being the next fin to be compressed, including moving a first blade (34) of the clamping means (28) into the first space (22) of the second fin (14*b*), and (iii) contacting the other side (18) of the first fin (14*a*) at an intermediate area thereof, including moving a second blade (36) of the clamping means (28) into the second space (26) between the first (14*a*) and second (14*b*) fins;

(c) bringing closer together the two sides (16,18) of the first fin (14*a*) with the clamping means (28) to make the two sides (16,18) substantially parallel, including (i) maintaining stationary the one side (16) of the first fin (14*a*), and (ii) moving the other side (18) of the first fin (14*a*) towards the one side (16);

(d) unclamping the sheet (10);

(e) moving the second fin (14*b*) into the work station to compress the second fin; and (f) repeating steps (b) through (e).

3. A method according to claim 2, wherein the steps of moving the first (30) and second (32) members and moving the first (34) and second (36) blades occur simultaneously.

4. A method according to claim 2, wherein the step of moving the other side (18) of the first fin (14*a*) comprises moving the first blade (34) and the second blade (36) simultaneously towards the first (30) and second (32) members.

5. A method according to claim 2, wherein the step of unclamping comprises simultaneously moving the first (30) and second (32) members and the first (34) and second (36) blades away from the sheet (10).

* * * * *

UNITED STATES PATENT AND TRADEMARK OFFICE

CERTIFICATE OF CORRECTION

PATENT NO. : 4,275,581

DATED : June 30, 1981

INVENTOR(S) : Kenneth J. Miller

It is certified that error appears in the above-identified patent and that said Letters Patent are hereby corrected as shown below:

Column 1, line 6, change "an apparatus and" to --a--.

Column 1, line 9, after "Apparatus" add --and methods--.

Column 1, line 15, change "is" to --are--.

Column 1, line 36, after "apparatus" and before "," add --and method--.

Column 1, line 53, after "apparatus" change "is" to --and method are--.

Column 1, line 55, after "apparatus" add --and methods--.

Column 1, lines 60-68, and column 2, lines 1-11, delete the entire two paragraphs and substitute the following therefor:

--In one aspect of the present invention, a method is provided for increasing the fin density of a serpentine sheet having a plurality of fins, each fin having first and second diverging sides connected to each other at one rounded end thereof with a fin being connected to the other end of the second side of the preceding fin to form another rounded end and the other end of the second side of a fin being connected to the other end of the first side of a fin being connected to the other end of the first side of the succeeding fin, and two adjacent fins having a second space therebetween, the method comprising:

a) vertically moving a first clamping member onto the other rounded end;

b) vertically moving a second clamping member onto the one rounded end of one fin.

c) vertically moving a first blade into the first space of an adjacent fin succeeding the one fin and into contact with an intermediate area of the first side thereof;

UNITED STATES PATENT AND TRADEMARK OFFICE

CERTIFICATE OF CORRECTION

PATENT NO. : 4,275,581

DATED : June 30, 1981

INVENTOR(S) : Kenneth J. Miller

It is certified that error appears in the above-identified patent and that said Letters Patent are hereby corrected as shown below:

d) vertically moving a second blade into the second space between the one fin and the adjacent fin and into contact with an intermediate area of the second side of the one fin;

e) moving the first blade and the second blade laterally towards the first clamping member and the second clamping member to reduce the divergence of the first and second sides of a fin; and f) vertically moving the first clamping member, the second clamping member, the first blade and the second blade away from the one fin after moving the first blade and the second blade laterally.

Column 2, line 13, after "apparatus" change "is" to --and method are--.

Column 2, line 30, delete "and apparatus".

Column 2, line 32, after "apparatus" add --and method--.

Column 2, line 34, after "apparatus" add --and method--.

Column 2, line 48, after "apparatus" add --used to perform the method--.

Column 2, line 50, after "apparatus" add --used to perform the method--.

Column 7, claim 1, line 25, after "end (24, 25)" add --;--.

Signed and Sealed this

*Seventeenth* Day of *May 1983*

[SEAL]

*Attest:*

DONALD J. QUIGG

*Attesting Officer* *Acting Commissioner of Patents and Trademarks*